US011000864B2

(12) United States Patent
Mickos

(10) Patent No.: US 11,000,864 B2
(45) Date of Patent: May 11, 2021

(54) WATER-SAVING NOZZLE MOUNTABLE ON A FAUCET

(71) Applicant: STOCKHOLM AB, Stockholm (SE)

(72) Inventor: Kaj Verner Mickos, Nacka (SE)

(73) Assignee: ALTERED STOCKHOLM AB, Stockholm (SE)

( * ) Notice: Subject to any disclaimer, the term of this patent is extended or adjusted under 35 U.S.C. 154(b) by 110 days.

(21) Appl. No.: 16/067,667

(22) PCT Filed: Jan. 26, 2017

(86) PCT No.: PCT/US2017/015004
§ 371 (c)(1),
(2) Date: Jul. 2, 2018

(87) PCT Pub. No.: WO2017/136209
PCT Pub. Date: Aug. 10, 2017

(65) Prior Publication Data

US 2019/0001351 A1 Jan. 3, 2019

Related U.S. Application Data

(60) Provisional application No. 62/291,748, filed on Feb. 5, 2016.

(51) Int. Cl.
*B05B 1/34* (2006.01)
*B05B 1/12* (2006.01)
(Continued)

(52) U.S. Cl.
CPC ..... *B05B 1/34* (2013.01); *B05B 1/06* (2013.01); *B05B 1/12* (2013.01); *B05B 1/3415* (2013.01);
(Continued)

(58) Field of Classification Search
CPC .... B05B 1/12; B05B 1/34; B05B 1/30; B05B 1/18; B05B 1/3405; B05B 1/341;
(Continued)

(56) References Cited

U.S. PATENT DOCUMENTS 3,514,042 A * 5/1970 Freed ..... B05B 1/1681 239/458
3,945,574 A * 3/1976 Polnauer ..... B05B 7/10 239/404
(Continued)

*Primary Examiner* — Qingzhang Zhou
*Assistant Examiner* — Christopher R Dandridge
(74) *Attorney, Agent, or Firm* — Fasth Law Offices; Rolf Fasth

(57) ABSTRACT

The method is for discharging water through a faucet. The nozzle is attachable to a faucet and switchable between a spray-mode and a mist-mode. An inner cavity has filters and a water rotating device. The housing has an opening defined therein in fluid communication with the inner cavity and grooves and an orifice at a bottom portion thereof. The second filter is disposed below the opening. When in the spray-mode, water flows out through the opening and through grooves and is discharged as spray and mist at a bottom of nozzle. When switched to the mist mode, water only flow through the second filter but not through the opening. Water flows through the water rotating device to create a rotation of the water and the rotating water is discharged through the orifice as mist.

9 Claims, 6 Drawing Sheets

(51) Int. Cl.
*B05B 1/06* (2006.01)
*B05B 12/18* (2018.01)
*B05B 15/40* (2018.01)

(52) U.S. Cl.
CPC ..... *B05B 1/3478* (2013.01); *B05B 12/18* (2018.02); *B05B 15/40* (2018.02)

(58) Field of Classification Search
CPC ... B05B 1/3415; B05B 1/3431; B05B 1/3452; B05B 1/3489; E03C 1/08; E03C 1/084
See application file for complete search history.

(56) References Cited

U.S. PATENT DOCUMENTS

| | | | | | |
|---|---|---|---|---|---|
| 3,999,714 | A * | 12/1976 | Lang | B05B 1/18 | 239/570 |
| 4,154,402 | A * | 5/1979 | Fletcher | B05B 1/08 | 239/487 |
| 4,173,325 | A | 11/1979 | Petrovic | | |
| 4,618,100 | A * | 10/1986 | White | B05B 1/12 | 239/440 |
| 6,277,292 | B1 * | 8/2001 | Reid | C02F 1/003 | 210/205 |
| 9,447,567 | B2 * | 9/2016 | Huang | E03C 1/084 | |
| 2001/0023901 | A1 * | 9/2001 | Haverstraw | B05B 1/1636 | 239/443 |
| 2007/0290079 | A1 * | 12/2007 | Laidler | B05B 15/40 | 239/590 |

* cited by examiner

WATER-SAVING NOZZLE MOUNTABLE ON A FAUCET

PRIOR APPLICATION

This application is a U.S. national phase application based on International Application No. PCT/US2017/015004, filed 20 Jan. 2017, claiming priority from U.S. Provisional Patent Application No. 62/291,748, filed 5 Feb. 2016.

TECHNICAL FIELD

The present invention relates to a nozzle that is mountable on a faucet or shower to lower water-consumption and to clean the water. The nozzle is adjustable between a mist-mode and a spray-mode.

BACKGROUND AND SUMMARY OF THE INVENTION

In many parts of the world, there is a tremendous need to reduce water consumption. Not only is the lack of water a problem but the low water quality of the available water is also another equally important problem. Low water quality is often as big of a problem as the lack of available water because people often get seriously sick from drinking contaminated or unclean water. A primary object of the present invention is to present a nozzle that performs water saving functions when water is discharged from a faucet, showerhead or the like. Another primary object is to improve the water quality of the water that exits the nozzle of the present invention although the water source may be contaminated and unsuitable for drinking and other usages. As described in detail below, the large size of the filter cavity and the placement of the opening for the spray mode are important features that enable dual filtration of the water as the water flows through the nozzle.

A further object of the present invention is that the spray/mist nozzle according to the present invention is extremely simple but still robust in its design and function.

More particularly, the present invention is a method for discharging water through a faucet. A nozzle is attachable to a faucet. The nozzle is switchable between a spray-mode and a mist-mode and has a housing with an inner cavity. The inner cavity has a first and a second filter and a water rotating device disposed therein. The housing has an opening defined therein in fluid communication with the inner cavity and grooves and an orifice at a bottom portion thereof. The second filter is disposed below the opening. The nozzle is attached onto the faucet and can be switched to the spray-mode. Water then flows into the inner cavity and through the first filter. When in the spray-mode, water flows out through the opening and through grooves and is discharged as spray and mist at a bottom of nozzle. A portion of the water also flows through the second filter when the nozzle is in the spray mode so that some mist is discharged also. When switched to the mist mode, water only flows through the second filter but not through the opening. Water flows through the water rotating device to create a rotation of the water and the rotating water is discharged through the orifice as mist.

The method further includes rotating a handle in engagement with a rotatable sleeve to switch the nozzle between the mist mode and the spray mode.

The method further includes adjusting a flow of the water by rotating the sleeve relative to the housing.

The method further includes adjusting a flow of the water by rotating a vortex screw disposed in the cavity.

The method further includes discharging a tubular-shaped spray that encloses the mist and shapes or forms the mist into a tubular-shaped mist disposed inside the spray.

The method further includes switching the nozzle from the mist-mode to the spray-mode by moving the sleeve axially away so that the sleeve engages an O-ring so stop a water flow passed the O-ring.

The method further includes removing the sleeve from the housing by rotating the sleeve relative to the housing.

The method further includes passing water sideways across filter to clean the filter.

The method further includes providing a water flow reducing plug having an orifice defined therein to reduce a water flow through the cavity.

BRIEF DESCRIPTION OF THE DRAWINGS

A preferred embodiment of the nozzle according to the present invention will be described below, reference being made to the accompanying drawings where.

DETAILED DESCRIPTION

The nozzle 100 of the present invention is switchable between a mist mode and a spray mode. It is also possible that the nozzle is not switchable i.e. it only has the mist mode or the spray mode. The nozzle 100 has a very reliable and robust design that is easy to maintain. When in the spray mode, the water flow is lowered to about 10% of the normal water flow coming out of a conventional faucet 108. When in the mist mode, the water flow is lowered to about 1% of the normal water flow of the faucet 108. As an example, the nozzle only consumes about 0.2 liters/minute when a 0.5 mm orifice is used and the water pressure is about 6-7 $kg/cm^2$. As mentioned above, when in the spray mode, the water flow is lowered to about 10% of the normal water flow of the faucet 108. As explained in detail below, the mist is created through a flash evaporation process with a minimum consumption of water.

Figure 1:
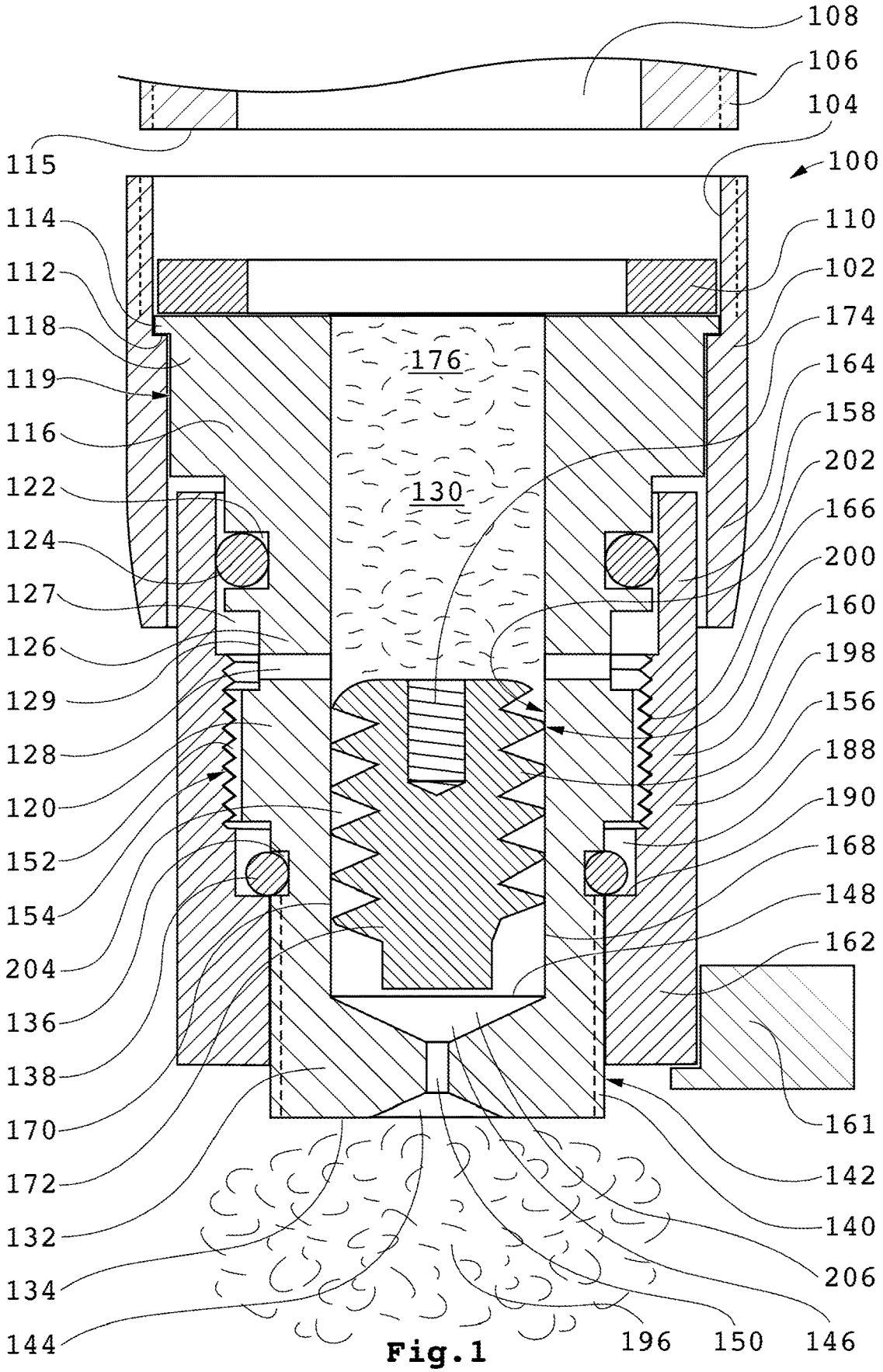
FIG. 1 is a cross-sectional view of the nozzle of the present invention when the nozzle is in a mist mode.
Figure 2:
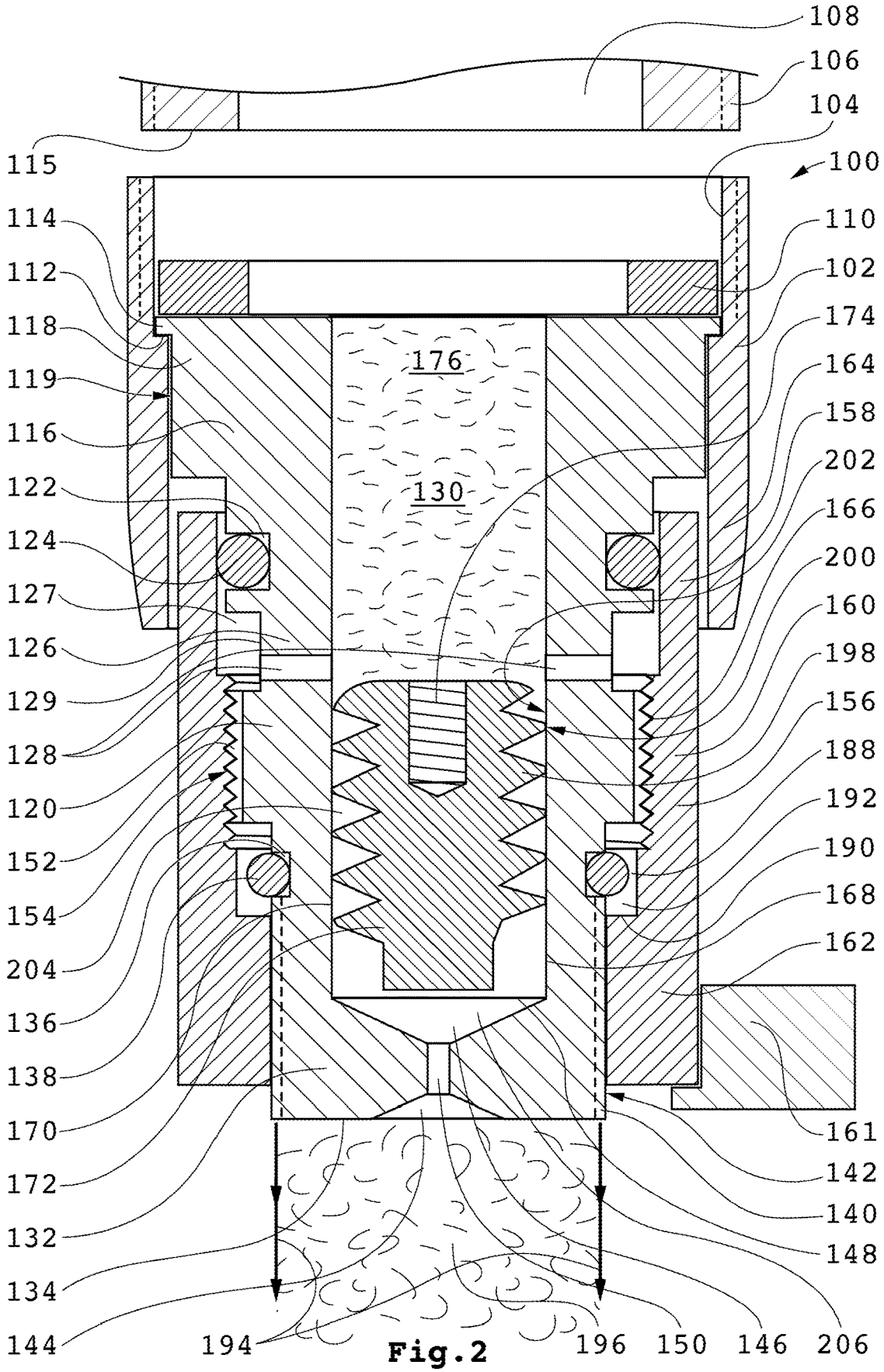
FIG. 2 is a cross-sectional view of the nozzle shown in FIG. 1 when the nozzle is in a spray mode.
Figure 3:
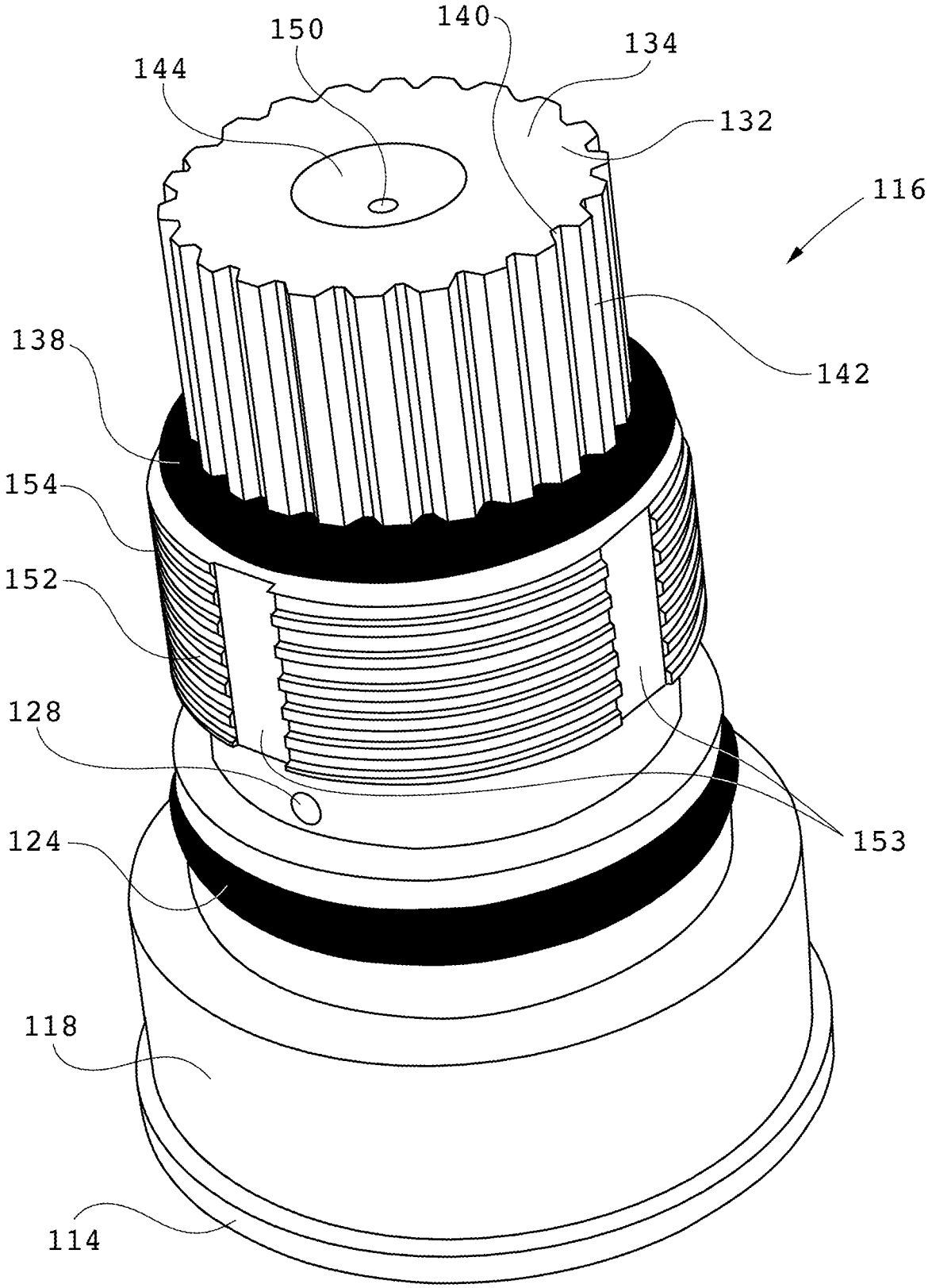
FIG. 3 is a perspective view of the housing turned upside down to show the orifice defined in the bottom surface.

With reference to FIGS. 1-4, the nozzle 100 has a hollow cylindrical-shaped removable casing 102 with an internal thread 104 that is attachable to external threads 106 at a bottom end of the conventional faucet 108 (only a portion of the faucet is shown in FIGS. 1-2) by screwing it onto the faucet 108. This is an important feature because it means that the nozzle 100 of the current invention is an accessory that may be mounted on a conventional faucet without the need to replace the faucet. The nozzle may also be attached to any suitable water supplying device such as to a shower. It is also possible to use another mounting device that is different from the casing 102.

The casing 102 may also conveniently be removed from the faucet 108 by simply un-screwing it therefrom. A flexible sealing O-ring 110 is located inside the casing 102. The casing 102 has an internal shelf 112 that is adapted to engage an outwardly protruding upper lip 114 of a housing 116 so that the lip 114 rests on the shelf 112 when the housing 116 is mounted inside the casing 102. When the casing 102 is screwed onto faucet 108, the lip 114 and a lower end 115 of faucet 108 prevent axial movement of the housing 116 relative to the faucet 108. The O-ring 110 prevents any undesirable leakage of water between the casing 102 and the housing 116. The housing 116 has a large diameter upper cup-portion 118 with a cylindrical smooth outer surface 119 that, preferably, does not contain a threaded portion. The housing 116 has a mid-section 120 that has an outer diameter that is smaller than the outer diameter of the cup-portion 118. The mid-section 120 has an external annular groove 122 defined therein for seating a sealing flexible O-ring 124. The O-ring 124 prevents water from leaking between the housing 116 and a sleeve 156. The mid-section 120 has a narrow waist-portion 126 defined therein that has an annular space or groove 127 defined therein. The mid-section 120 has an outer threaded portion 152 at an outer peripheral surface 154 of the mid-section 120. The threaded portion 152 has longitudinal channels 153 (best seen in FIG. 3) defined therein that extend from the top of the threaded portion 152 to the bottom of the threaded portion 152. The channels 153 may be used to further increase the water flow passing through the threaded portion 152, as explained in more detail below. The waist-portion 126 has openings 128 defined therein that extends from an outer surface 129 of the waist-portion 126 into an inner cavity 130 defined inside housing 116 so that the inner cavity 130 is in fluid communication with the groove 127. Preferably, the openings 128 are located above a water rotating device 172. Many different water rotating devices may be used to rotate the water inside the inner cavity 130 prior to discharge. A vortex screw 172 is a preferred rotating device. The screw 172 is disposed inside and at a lower end of the inner cavity 130.

The housing 116 has a narrow bottom portion 132 that terminates at a bottom surface 134. The bottom portion 132 has an external annular groove 136 defined therein for seating a sealing O-ring 138. The O-ring 138 prevents water from leaking between the housing 116 and the sleeve 156 when the nozzle is in the mist mode (as shown in FIG. 1). The bottom portion 132 has elongate axial grooves or channels 140 defined on an outer surface 142 that extends from the groove 136 to the bottom surface 134. Because the housing 116 is removable from the sleeve 156, it is relatively easy to clean the grooves 140 to remove dirt that may assemble in the grooves during use. It was surprisingly discovered that the channels 140 function much better than openings or orifices in the long run because they permit the water to flow as well as when openings/orifices are used but are much easier to clean by simply unscrewing the sleeve 156 from the housing 116 to expose the grooves 140. The bottom surface 134 has a central conical-shaped cavity 144 defined therein. The housing 116 has a central conical-shaped cavity 146 defined therein at a bottom 148 of the inner cavity 130. The bottom portion 132 has a centrally disposed tubular-shaped discharge opening or orifice 150 defined therein that extends between the central cavity 144 and the central cavity 146. The cavity 144 has several functions. One is to protect the orifice 150 from external damage and to guide and shape the mist 196. In a preferred embodiment, the length of the orifice 150 should be about 0.5 millimeters and the diameter of the orifices could be between 0.3-0.8 millimeters. Most preferably, the diameter of the orifice 150 should be about 0.5 millimeters.

The removable and rotatable sleeve 156 has an upper portion 158, an intermediate portion 160 and a bottom portion 162. The upper portion 158 has a smooth inner surface that is adapted to tightly bear against the O-ring 124 when the sleeve 156 is inserted between a lower portion 164 of the casing 102 and the mid-section 120 of the housing 116. The intermediate portion 160 has an internal threaded portion 166 that may engage and be screwed onto the threaded portion 152 of the mid-section 120 of the housing 116 so that the sleeve 156 is rotatable relative to the housing 116 and can be removed therefrom. As explained in detail below, the sleeve 156 may be axially shifted, by, for example, rotating the sleeve 156 relative to the housing 116, to switch the nozzle 100 between the mist mode (FIG. 1) and the spray mode (FIG. 2). The sleeve 156 may have a handle 161 for switching or changing the nozzle between the two modes. The handle 161 may be removable from sleeve 156 and be mounted on the sleeve 156 after the sleeve 156 has been properly mounted on housing 116 inside casing 102 that in turn has been mounted on the faucet 108. The sleeve 156 may be delivered pre-mounted inside the casing 102 so that the user may simply screw the casing 102 onto the faucet 108 and the nozzle 100 is ready for use. The handle 161 may be designed so that it is held in the desired position by an O-ring or any other suitable fastening mechanism. The handle 161 may have instructions and logos attached thereto. Another feature is that regardless of how the casing 102 is mounted on the faucet 108, the user should be able to turn the handle 161 to a desired position. It is also possible to use a longer casing 102 that completely covers and encloses the sleeve 156 to make the design more aesthetically pleasing.

A lower end 168 of the inner cavity 130 has an internal threaded portion 170 that is adapted to engage the vortex screw 172 that is disposed inside and at the bottom of the inner cavity 130. The screw 172 has a removable and rotatable adjustment screw 174 for adjusting the position of the screw 172 relative to the inner cavity 130. In other words, the user may simply engage a screw-driver receiving groove defined at the top of screw 174 to rotate screw 172 relative to the inner walls of the inner cavity 130. The function of the screw 172 is important because it creates a vortex of the flowing water prior to the flash evaporation process via the orifice 150. The important feature is that the water is rotated by flowing along the helical-shaped treads 198 of the screw 172. It is to be understood that the creation of the vortex inside the inner cavity 130 may be accomplished in a way different from using the screw 172. The screw 172 may also be used to control or regulate the flow of water flowing through the threads of the screw 172. The screw 172 may, preferably, be rotated to move upwardly when the water pressure is lower and rotated to move downwardly when the water pressure is higher. By turning the screw 172 until it hits the bottom of the cavity 130, the water flow to the orifice 150 may be stopped completely and by un-screwing the screw 172, the water flow may be increased because there are fewer threads that are engaging threads on the inside wall of the cavity 130 which results is less friction between the two and because there is more room for the water to flow below the screw 172 and above the cavity 146. It is important to be able to regulate the water flow through the nozzle in case the water pressure coming out of the faucet 108 is unusually high or low. Because the screw 172 is removable, it is easy to clean the threads of the screw and the threads 170 on the inside of the cavity 130.

Preferably, a removable water filter 176 is disposed inside the inner cavity 130. The filter should be disposed above the screw 172 or extend to the top of the screw 172. Because the water-flow through the filter 176 is relatively low, it is possible to effectively affect the properties of the water such as by treating the filter with oxides of titan or copper to clean or purify the water from bacteria and other undesirable substances. It may also be possible to treat the surface of the screw 172 in order to treat or purify the water flowing between the threads of the screw and the inner wall of the inner cavity 130.

Figure 4:
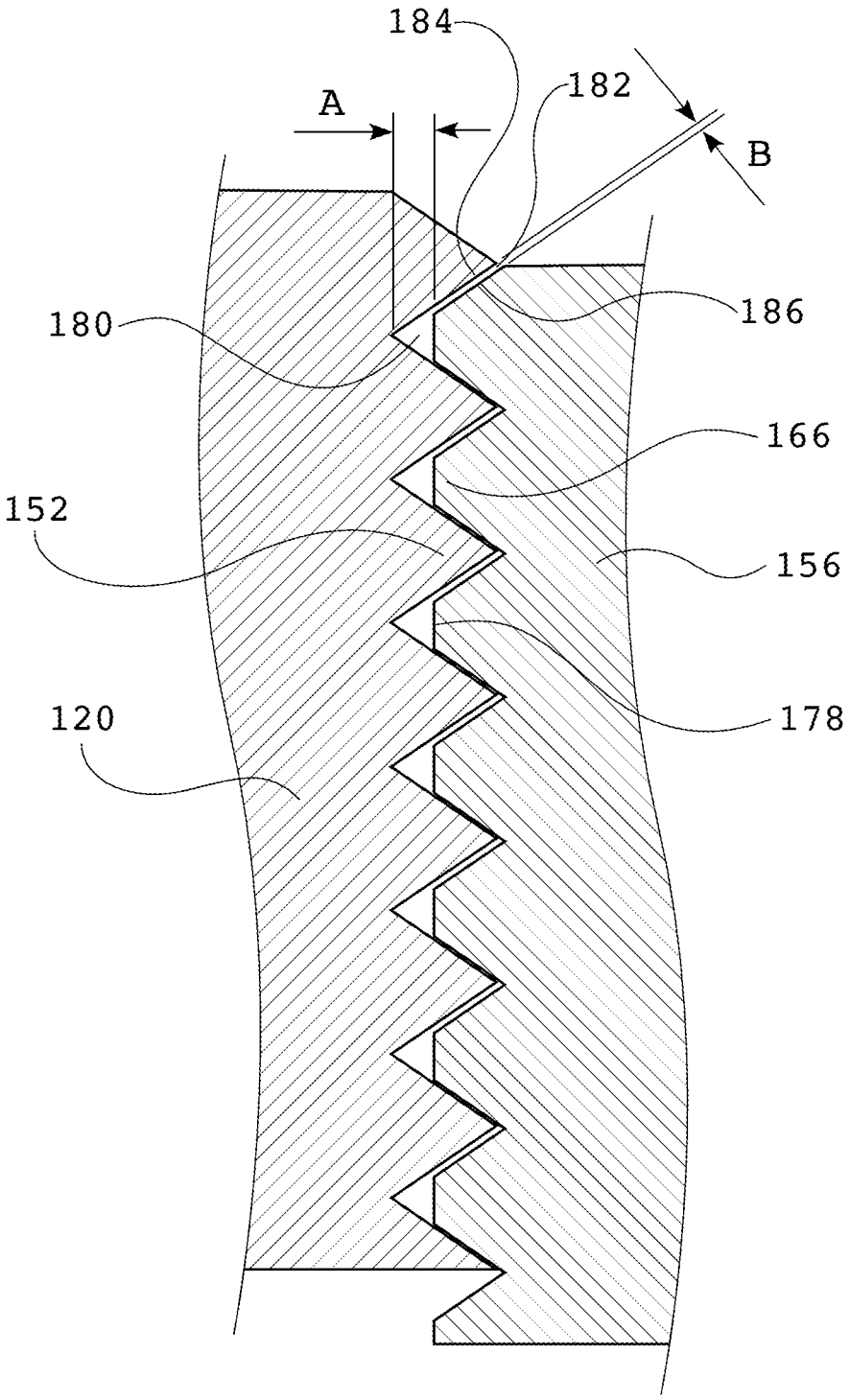
FIG. 4 is a cross-sectional detailed view of the threaded connection between the sleeve and the housing.

FIG. 4 is a detailed cross-sectional view of the threaded engagement between the treaded portion 152 of mid-portion 120 and the treaded portion 166 of the sleeve 156. Preferably, the treaded portion 166 has truncated tops 178 so that cavities 180 having a depth (A) are formed between the treaded portion 152 and the threaded portion 166 to allow water to pass through the threaded portions although they are engaged to one another. The angles of the threaded portions 152, 166 are such that a channel 182, having a width (B), is formed between an angular surface 184 of the threaded portion 152 and an angular surface 186 of the threaded portion 166 so that water may pass through the channel 182 although the threaded portions are engaging one another. The water flow may be regulated by adjusting or changing the depth (A) and width (B) by rotating the sleeve 156 relative to the mid-section 120. The idea of passing the water between two threaded portions has turned out to work unexpectedly and surprisingly well because the threaded portions may be removed from one another and are easy to clean. Also, the threads are moved relatively to one another which also have a cleaning function because dirt inside the treaded portions is disintegrated by the relative movement of the threads. The sleeve 156 may also be rotated relative to the housing 116 to make the relative contact of the threaded portions more or less tight to regulate or control the water flow through the threaded portions.

In operation, the nozzle 100 is first properly mounted on the faucet 108 or the like. The nozzle is switchable between spray-mode and the mist mode so that a first portion of the water is used to create spray and a second portion of the water is used to create mist. A typical pressure of the water that is discharged from the faucet is about 2-3 bar. Water flows from faucet 108 through filter 176 and into the inner cavity 130. When the nozzle 100 is in the mist mode, as shown in FIG. 1, the second portion of the water can only flow via the vortex screw 172 and out through orifice 150 and is flash evaporated into a conical-shaped mist 196. It is advantageous to have a conical-shaped mist when, for example, washing hands below the nozzle 100. As described in detail below, the shape of the mist is changed from a conical-shape to a tubular-shape when the nozzle is switched to the spray mode. It is then advantageous that the mist is tubular-shaped because the mist together with the spray water is usually directed into a container.

More particularly, the water flows through the relatively large helical-shaped threads 198 of which only the top portions 200 engage an inside threaded surface 202 at the lower end of the inner cavity 130. Preferably, the threads 198 are substantially greater than the threads of the threaded surface 200 to facilitate the flow of water along the helical shape of the threads 198. In this way, the threads 198 form a helical-shaped pathway for the water to rotate the water prior to being discharged into the vortex chamber 206 below the vortex screw 172. In other words, because the threads 198 are large relative to the threaded surface 202, a helical-shaped cavity 204 is formed between the threads 198 and the threaded surface 202 that extends from the top of the screw 172 to the bottom thereof and into the vortex chamber 206 that is formed below the screw 172 and in the cavity 146. The water thus rotates in the cavity 146 before entering the tubular-shaped orifice 150 and out through cavity 144 by flash evaporation as mist 196. In this way, the water descends towards the tubular-shaped orifice 150 and the water is discharged through the orifice 150. When the water leaves the orifice 150 the water assumes the shape of a cone that follows the cone-shaped cavity 144. Due to the relatively small opening area of the orifice 150 the water consumption is kept at a low level when the nozzle 100 is mounted on the faucet.

The water is atomized in the nozzle 100 so that the fine mist or fog 196 (best seen in FIG. 1) is ejected therefrom that includes almost an infinite number of water droplets. The mist-function of the nozzle 100 converts the water into the fine mist 196 by using high pressure. The water droplets released through the nozzle 100 are so small that they are measured in microns. The surface area of the water is very large and it is possible to maximize the use of the surface area of each droplet. This is because the diameter of the orifice 150 is exceptionally small. When the water passes through the nozzle 100, it is effectively vaporized as a result of flash evaporation. As a result of flash evaporation, the cone-shaped mist 196 is formed. It is important to produce the right size of the droplets. When the droplets are too small, the water evaporates into a smoke-like mist that is difficult to use and control to form the desired cone-shape. Preferably, the droplets should have a sufficient size and mass to form a sustainable and stable cone-shaped mist that is adjusted by adjusting the screw 172 depending on the prevailing water pressure coming out of the faucet 108, as described above.

When the nozzle 100 is in the spray-function, the first portion of the water comes out both as spray 194 while the second portion of the water comes out as mist 196. The spray 194 has downwardly directed and straight jets that together form a tubular shaped water-flow so that the spray 194 encloses the mist 196 and so that the shape of the mist 196 is changed from a conical-shape to a tubular-shape and is directed downwardly inside the jets of the spray 194. The spray 194 thus has the additional surprising function of changing the cone-shaped mist 196 to a tubular-shape mist inside the water jets of the spray that in turn reduces the amount of mist that is wasted and more of the water contained in the mist is actually used by the user. The spray-function may be used when there is a need for a higher water flow (compared to the generated water flow when the nozzle is in the mist-function) such as when filling a container with water. Preferably, the bottom portion 132 should protrude 1-2 millimeters beyond the bottom of the sleeve 156 so that the water jets of the spray 194 are not interfered by the sleeve 156 and to reduce the risk of clogging of the channels 140, as described below.

The mist 196 is particularly suitable for hand washing while reducing the water consumption without reduced efficiency or comfort. The water consumption could be as low as 50 milliliter for a normal hand-wash. One surprising effect is that it is possible to effectively wash the hands despite the extremely low consumption of water. The water may be disinfected during the washing by used a bacteria killing filter such as a silver-oxide based filter or any other suitable filter. In other words, the water is subjected to a silver-based substance. It is also possible to use an ultraviolet light device so that ultraviolet light is directed towards the mist 196 while making the mist visible. It is possible to use a sensor that automatically activates the faucet 108 when hands are inserted under the faucet 108.

When the nozzle 100 is in the spray mode, as shown in FIG. 2, the water also flows out through openings 128 and into cavity 127 in addition to flowing through the vortex screw 172, as described above. The screw 172 is adjusted within the cavity 130 to regulate or control the flow of water flowing through the screw 172. Even when the nozzle 100 is in the spray-mode, the water consumption is substantially less than what the water consumption would be without the nozzle 100 of the present invention. The O-ring 124 prevents the water from flowing between the upper portion 158 of the sleeve 156 and the mid-section 120 of the housing 116. The water then flows through the channels 182 and cavities 180 (best shown in FIG. 4) so that the water flows through the entire threaded portions 152, 166 although they are engaged to one another. Some water also flows through the axial channels 153 that enhance the water flow. The water enters a chamber 188 that is defined between the intermediate section 160 of the sleeve 156 and the upper end of the lower portion 132 at the O-ring 138. When the nozzle 100 is in the mist-mode (as shown in FIG. 1) the water is prevented from any further flow by the O-ring 138. As explained in more detail above, the water is then only permitted to flow via the inner chamber 130 through the vortex screw 172 and out through the orifice 150. When the nozzle 100 is in the spray mode (as shown in FIG. 2), an engaging surface 190 of the sleeve 156 that sealingly engages a bottom of the O-ring 138 is moved away from the O-ring 138 so that a chamber 192 is created between the O-ring 138 and the engaging surface 190. The chamber 192 permits the water to flow therethrough and into the longitudinal channels 140 that terminates at the bottom surface 134. In this way, the water may flow through the entire nozzle 100 and form a spray 194 that includes peripheral water jets of a circular water flow flowing out from the channels 140 around the outer periphery of the bottom surface 134, as best shown in FIG. 2. Preferably, the spray 194 is tubular shaped to enclose the mist 196 and force the mist to also take the shape of a tubular-shape.

It is also possible to automatically eject a suitable amount of soap from a soap source before the mist is turned on. The hand may also be automatically showered with alcohol from an alcohol source. A suitable perfume with a pleasant smell may be added to the water since the consumption is so small. It may also be possible to add a taste to the water flowing inside the nozzle. Because the filter 176 is removable, it is possible to replace the filter 176 when needed such as when it is dirty or when it is desirable to change the treatment of the water such as changing to a different smell, color or taste. It is also possible to heat the water with an electric devise directly at the faucet and to use a multiple of spray nozzles together to form a shower.

It is also possible to connect the nozzle to a container containing water and air where the air is compressed by the means of a pump or the like to force the water to exit from the container through a tube passing filters and silver/copper ions, or the like, to purify the water and ending with a nozzle connected to the tube creating a mist for economical use of the purified water.

Figure 5:
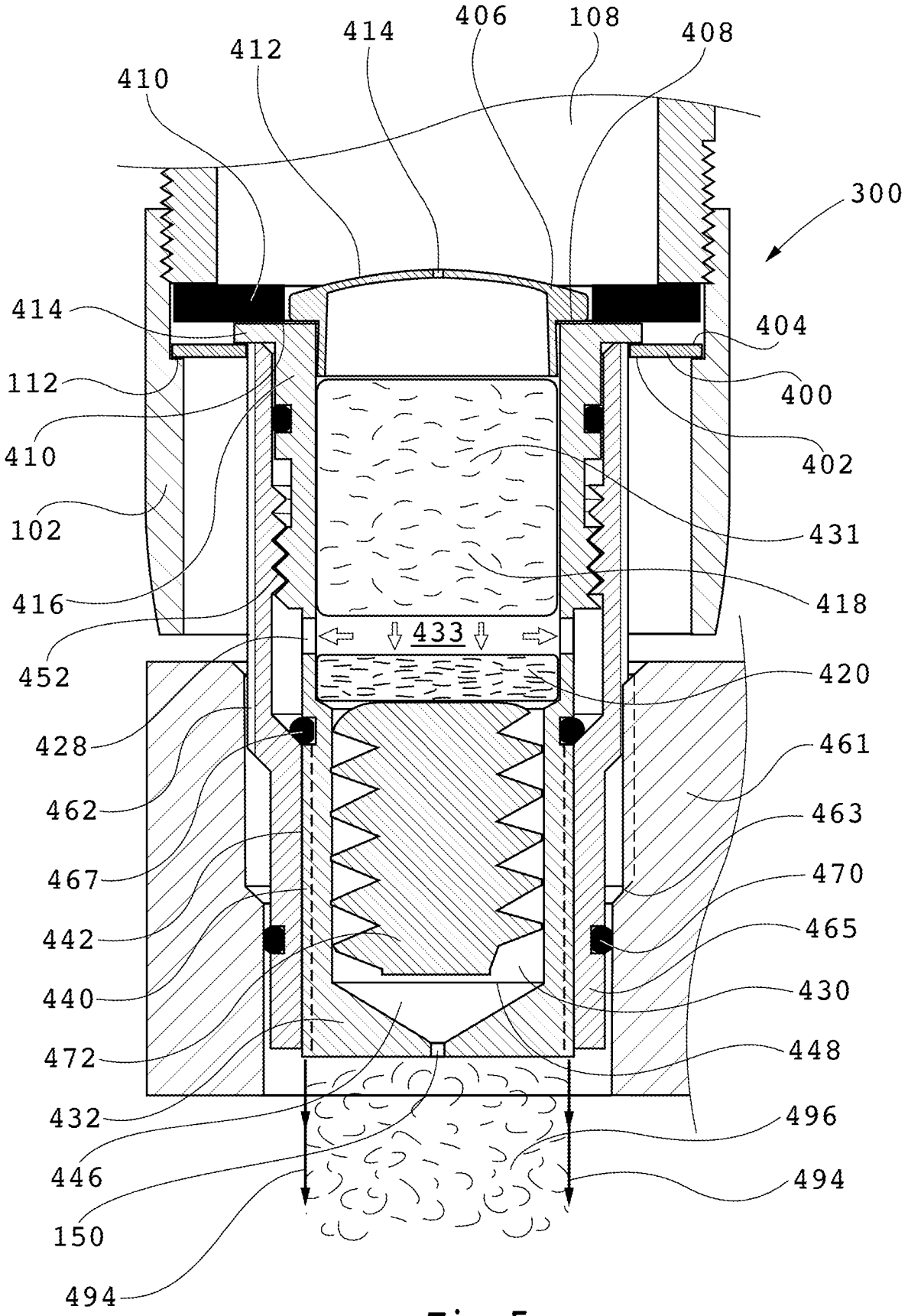
FIG. 5 is a cross-sectional view of a first alternative embodiment of the nozzle of the present invention.

FIG. 5 shows a first alternative embodiment of the nozzle 300 of the present invention. All the features and method steps described in connection with nozzle 100 also apply to nozzle 300. The nozzle 300 is thus virtually identical to the nozzle 100 except for the additional features described below. The main difference between nozzle 100 and nozzle 300 is that the openings 128 are located above the threaded portion 152 while in nozzle 300, the openings 428 are located below the threaded portion. This has the advantage, among other things, that there is no need for the water to flow through the threaded portion when the nozzle 300 is in the spray mode. Another advantage is that the nozzle 300 has a "one size fits all" feature.

The O-ring 410 should have a size to prevent the nozzle 300 from being able to be pushed into the inside of the faucet 108. Nozzle 300 is also switchable between a mist mode and a spray mode. One important feature of nozzle 300 is that it has an adjustment ring 400 so that it can be fitted into faucets, a so called "one size fits all" that has an inner diameter greater than an outer diameter of nozzle 300. The ring or rings 400 may be made metal or plastic and have various diameters or thicknesses. The rings may also be open, i.e. not fully enclosed, so that it can be flexible and bent open to fit onto a tubular member so that it snugly fits thereon when allowed to retract again. The rings may also have different colors depending on the ring size. In other words, the nozzle 300 may have adjustment rings of different sizes so that nozzle 300 fits all sizes of faucets. Instead of the upper lip 414 resting on the shelf 112 (as shown in FIGS. 1-4), an inner portion 402 of ring 400 provides support for upper lip 414 and an outer portion 404 of ring 400 rests on shelf 112 of casing 102. In this way, the combination of the O-ring 410 and the adjustment ring 400 attach and hold the housing 416 to the casing 102 and prevent the housing 416 from axially sliding relative to the casing 102. Similar to nozzle 100, the flexible sealing O-ring 410 is located inside casing 102. The size of O-ring 410 may also be adjusted to the size of the casing 102 that fits into (i.e. internal threads) or outside (i.e. outside threads) the faucet 108. This makes it possible to only make one size of the nozzle and use the rings to adjust to the size of the faucet 108. The O-ring 410 also properly centers the nozzle 300 in the faucet.

Another feature is that nozzle 300, preferably, has a water-flow reducing plug 406 that has a support surface 408 resting on an upper surface 410 of housing 416. The plug 406 is particularly suitable for bathroom sink applications while the plug may be removed for kitchen applications where it is necessary to have an increased flow especially when cleaning pans etc. and when there is a need for a higher flow. The plug 406 is inserted into housing 416 until support surface 408 rests on upper surface 410. The plug 406 preferably has a curved upper surface 412 with a central opening 414 defined therein so that water cannot pass into housing 416 without first passing opening 414. This reduces the water flow into nozzle 300. Preferably, the nozzle 300 has a particle filter 418 above an ultra-filter 420 disposed inside a filter cavity 431 at the upper end of cavity 430 inside housing 416. In other words, filter cavity 431 is the upper end of cavity 430. The particle filter 418 may also extend into the inside of plug 406 when needed. An important feature is thus that the nozzle 300 has a dual filter feature. The particle/correction filter 418 removes undesirable smell and taste from the water. The filter also removes or filters out undesirable metals from the water. All water (when nozzle 300 is in the spray mode or mist mode) that flows through nozzle 300 must flow through filter 418. The relatively large filter cavity 431 in the nozzle makes it possible to place the large multi-functional filter 418 in the cavity. Preferably, filter 418 should have a flow rate of at least 6 liters/minute at 6 bars water pressure. Filters that can handle other flow rates may also be used.

An ultra-filter 420, disposed below filter 418, is preferably designed to remove extremely small and pathogenic particles such as virus particles, bacteria, salt and other undesirable particles/substances. When the nozzle 300 is in the mist mode, the water flows through the ultra-filter 420 (but not through openings 428, as explained in detail below). This means the water particles or mist that flow out at the bottom of nozzle 300 is double filtered (flowing first through filter 418 and then filter 420) and is completely clean because it does not contain dangerous pathogenic particles. Preferably, there is a gap 433 between a bottom surface of filter 418 and a top surface of filter 420 at the opening 428. One problem of using ultra-filters is that they have a tendency to clog up. However, by switching the nozzle between the mist mode and the spray mode, the water flows inside housing 416 increases to such an extent that the filter 420 is cleaned out so that filter 420 can be used much longer without clogging up. More particularly, the filter 420 is self-cleaning because the water first flows into gap 433 and then sideways across the top surface of filter 420 and out through openings 428 when the nozzle 300 is in the spray mode. This side-flow of the water removes micro-particles and other particles from the top surface of filter 420. The low water flow, when nozzle 300 is in the mist mode, makes it possible to use the low permeability filter 420 which in turn lowers the water consumption to 0.15-0.30 liter/minute at a water pressure of 6 bars.

Both filter 418 and 420 are replaceable. The filter 418 may be adapted to the water quality and to what is to be filtered away. As indicated above, it is also possible that because filter 420 is placed immediately below opening or openings 428 (used when nozzle 300 is in the spray mode) filter 420 may be washed by the relatively high flow rate of the water exiting openings 428 when the nozzle 300 is in the spray mode.

Another feature is that a removable handle 461 may slide along grooves on an outside surface of the bottom portion 462 to a desired position thereon. More particularly, the handle 461 engages an O-ring 470 to hold the handle 461 to the sleeve 465 so that by turning or rotating the handle 461 the sleeve 465 is turned/rotated also relative to housing 416 by engaging the threaded portion 452. By turning the handle 461, the nozzle 300 is switched between spray mode to mist mode and vice-versa. More particularly, when a chamfered segment 463 is pushed against a seal or O-ring 467 to put the nozzle 300 in the mist mode, the water is prevented from flowing past O-ring 467. When the handle 461 is rotated or turned to move the chamfered portion 463 away from O-ring 467, nozzle 300 is switched from mist mode to spray mode because water is permitted to flow past the O-ring 467 and into elongate vertical grooves 440 defined in an outer surface 442 of housing 416. In this way, when the nozzle 300 is in the mist mode, no water flows out through openings 428. When the nozzle 300 is in the spray mode, water flows out through openings 428 and some water also flows through ultra-filter 420 so that both a spray 494 and a mist 496 are ejected at the bottom of nozzle 300.

Yet another feature is that nozzle 300 has the opening or openings 428 (equivalent to opening 128 in FIG. 1) located below the threaded portion 452 instead of above the threaded portion where the opening 128 is located. One advantage of this location of opening 428 is that it is no longer necessary for the water to pass through the threaded portions 152/166, as explained in detail in FIG. 4. This features makes the construction simple and reliable. An additional important feature is thus that filter 420 is located below opening 428 (only used when the nozzle is in the spray mode) so that it filtrates water when the nozzle 300 is in the mist mode.

At the lower end of the cavity 430, i.e. below the filters 418, 420 disposed in filter cavity 431, a vortex screw 472 is disposed therein. The screw 472 works the same way and has the same features as screw 172 described in detail above. The vertical position of vortex screw 472 (i.e. higher up or lower down) relative to the inner cavity 430 is important because it affects not only the flow of the water but also the angle of the cone of the screw 472 and the size of the water droplets which are all important variables to adjust nozzle 300 to the various water conditions. The screw 472 may be conical in order to better control the water flow when creating the mist. It is important to note that nozzle 300 can be switched between the spray-mode and mist-mode and back to spray-mode while water is running through nozzle 300 under pressure. It is thus not necessary to turn on the water flow before switching the nozzle 300 with handle 461 between the two modes. The nozzle 300 is designed so that the switching is smooth without any rapid pressure changes that may damages the water system and the nozzle.

The housing 416 has a central conical-shaped cavity 446 defined therein at a bottom 448 of the inner cavity 430. The bottom portion 432 has a centrally disposed tubular-shaped discharge opening or orifice 450 defined therein that extends between the bottom surface of the bottom portion 432 and the central cavity 446. The mist 496 exits through orifice 450 (while the spray exits through the grooves 440). In a preferred embodiment, the length of the orifice 450 should be about 0.5 millimeters and the diameter of the orifices could be between 0.3-0.8 millimeters. Most preferably, the diameter of the orifice 450 should be about 0.5 millimeters. The orifice 450 and grooves 440 may be made of or covered with a soft material such as silicone so that they are easier to clean.

Figure 6:
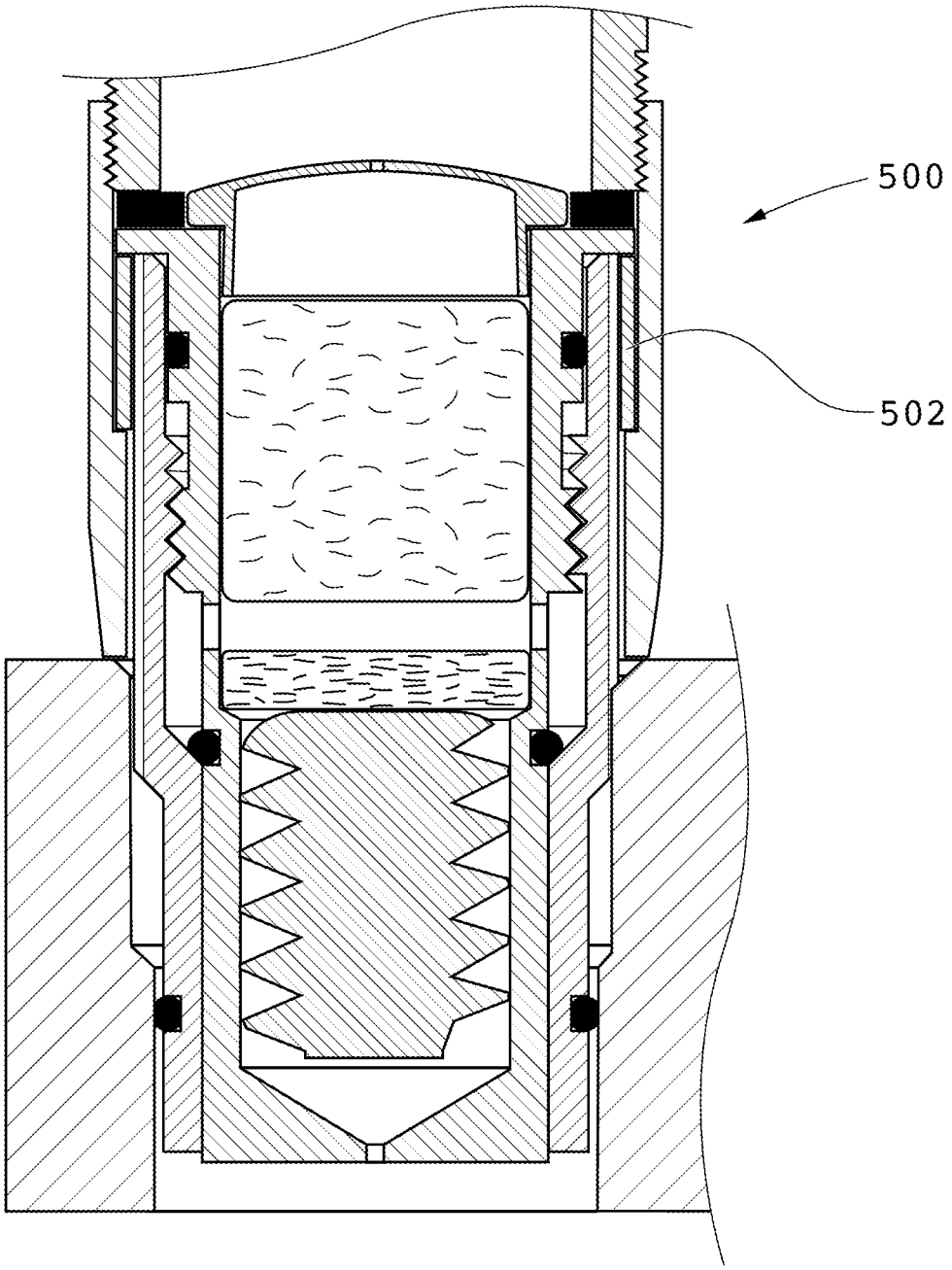
FIG. 6 is a cross-sectional view of a second alternative embodiment of the nozzle of the present invention.

FIG. 6 shows a second embodiment of nozzle 500 that is virtually identical to nozzle 300 expect that nozzle 500 has an adjustment sleeve 502 instead of adjustment ring 400. Nozzle 500 is preferred when the faucet 108 is only slightly too big for nozzle 500.

There are many possible variations of nozzle of the present invention. For example, instead of using the threads of screw 472 to create the helical path of the water, it is possible to have threads on the inside wall of chamber 430 and have a plug that is movable in the longitudinal direction, similar to how screw 432 is movable in the longitudinal direction, so that the correct vertical position of the plug can be adjusted to the pressure of the incoming water. It is important to be able to longitudinally shift the plug/screw inside the chamber 430 in order to obtain the correct vertical position when creating the mist. Also, the present invention is not limited to using merely one opening 150 per faucet. It is also possible to many openings 150 next to one another. The plurality of exit openings 150 may have one common filter set 418, 420 or one filter set 418, 420 for each opening. When nozzle 300 is used for shower applications, it is desirable to use larger mist droplets to better maintain the warm temperature of the shower mist. This means a narrower angle of the screw 432 is used, as explained above. When the water pressure is low, it is desirable to use a bigger angle of the screw and smaller droplets. It is also possible to use active carbon substances in the filter 418. The feeding of water into the chamber 430, where the screw 472 is located, is currently longitudinal. It is also possible to feed the water transversely or horizontally into the lower end of the chamber 430 so that the feed water comes in from the side of the screw 472.

While the present invention has been described in accordance with preferred compositions and embodiments, it is to be understood that certain substitutions and alterations may be made thereto without departing from the spirit and scope of the following claims.

I claim:

1. A method of discharging water through a faucet, comprising:

providing a nozzle attachable to a faucet, the nozzle being switchable between a spray-mode and a mist-mode, the nozzle having a housing having an inner cavity defined therein, the inner cavity having a vortex screw disposed at a lower end therein, the housing having an opening defined therein in fluid communication with the inner cavity, the housing having longitudinal straight grooves defined therein and an orifice defined therein at a bottom portion thereof, the inner cavity having a first filter disposed at an upper end therein and above the vortex screw, the opening being disposed between the first filter and the vortex screw;

attaching the nozzle onto the faucet;

switching the nozzle to the spray-mode;

flowing water into the inner cavity and then through the first filter;

when in the spray-mode, flowing water out through the opening, disposed between the first filter and the vortex screw, and then through the grooves and discharging the water as a spray through the grooves at a bottom of the nozzle, switching the nozzle from the spray-mode to the mist-mode, flowing the water through the vortex screw to create a rotation of the water when passing the vortex screw;

rotating the vortex screw to engage helical-shaped threads with an internal threaded portion of the inner cavity to longitudinally shift the vortex screw relative to inner walls of the inner cavity to increase or reduce the water flow through the threads and to affect an angle of a cone-shape of a mist and a size of water droplets in the mist; and discharging the rotating water through the orifice as mist.

2. The method according to claim 1, wherein the method further comprises rotating a handle in engagement with a rotatable sleeve to switch the nozzle between the mist mode and the spray mode.

3. The method according to claim 2, wherein the method further comprises adjusting a flow of the water by rotating the sleeve relative to the housing.

4. The method according to claim 1, wherein the method further comprises discharging a tubular-shaped spray that encloses the mist and shapes or forms the mist into a tubular-shaped mist disposed inside the spray.

5. The method according to claim 2, wherein the method further comprises switching the nozzle from the mist-mode to the spray-mode by moving the sleeve axially away so that the sleeve engages an O-ring e-e- to stop a water flow pass the O-ring.

6. The method according to claim 2 wherein the method further comprises removing the sleeve from the housing by rotating the sleeve relative to the housing.

7. The method according to claim 1 wherein the method further comprises providing the inner cavity with a second filter that is disposed therein, the second filter being disposed below the opening and, when the nozzle is in the mist mode, flowing water through the second filter but not through the opening.

8. The method according to claim 1, wherein the method further comprises passing the water sideways across a second filter to clean the second filter.

9. The method according to claim 1 wherein the method further comprises providing a water flow reducing plug having an orifice defined therein to reduce a water flow through the cavity.

* * * * *